US010458656B2

(12) United States Patent
Jung et al.

(10) Patent No.: US 10,458,656 B2
(45) Date of Patent: Oct. 29, 2019

(54) SWITCH ASSEMBLY AND COOKING APPARATUS HAVING THE SAME

(71) Applicant: SAMSUNG ELECTRONICS CO., LTD., Suwon-si, Gyeonggi-do (KR)

(72) Inventors: Gwang Jin Jung, Suwon-si (KR); Byoung Woo Ko, Suwon-si (KR); Jung Kwon Kim, Seoul (KR); Chun Seong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/061,133

(22) PCT Filed: Dec. 12, 2016

(86) PCT No.: PCT/KR2016/014530
§ 371 (c)(1),
(2) Date: Jun. 11, 2018

(87) PCT Pub. No.: WO2017/116040
PCT Pub. Date: Jul. 6, 2017

(65) Prior Publication Data

US 2018/0356100 A1 Dec. 13, 2018

(30) Foreign Application Priority Data

Dec. 30, 2015 (KR) ..... 10-2015-0189227

(51) Int. Cl.
*F24C 3/00* (2006.01)
*H01H 9/18* (2006.01)
(Continued)

(52) U.S. Cl.
CPC ..... *F24C 3/008* (2013.01); *F24C 3/00* (2013.01); *F24C 7/082* (2013.01); *H01H 9/18* (2013.01);
(Continued)

(58) Field of Classification Search
CPC . F24C 3/008; F24C 3/00; F24C 7/082; H01H 9/18; H01H 9/181; H01H 19/02; H01H 19/025
See application file for complete search history.

(56) References Cited

U.S. PATENT DOCUMENTS

2014/0056022 A1* 2/2014 Camli ..... F24C 7/082 362/551

FOREIGN PATENT DOCUMENTS

EP 2 924 534 A2 9/2015
JP 2001-236860 8/2001
(Continued)

OTHER PUBLICATIONS

International Search Report dated Feb. 28, 2017 in corresponding International Patent Application No. PCT/KR2016/014530.
(Continued)

*Primary Examiner* — Anne M Hines
(74) *Attorney, Agent, or Firm* — Staas & Halsey LLP

(57) ABSTRACT

Disclosed herein is a cooking apparatus including a switch assembly configured to uniformly distribute light emitted around a switch.

A cooking apparatus includes a main body having a cooking chamber and a switch assembly rotatably mounted on the main body. The switch assembly includes a switch rotatably provided, a switch holder coupled to the switch and a light guide disposed between the switch and the switch holder to uniformly emit light emitted from a light source.

13 Claims, 14 Drawing Sheets

(51) Int. Cl.

| | |
|---|---|
| ***H01H 19/02*** | (2006.01) |
| ***F24C 7/08*** | (2006.01) |
| ***H05B 6/64*** | (2006.01) |
| *F24C 3/12* | (2006.01) |
| *G05G 1/10* | (2006.01) |

(52) U.S. Cl.

CPC ..... *H01H 9/181* (2013.01); *H01H 9/182* (2013.01); *H01H 19/02* (2013.01); *H01H 19/025* (2013.01); *H05B 6/6435* (2013.01); *F24C 3/126* (2013.01); *G05G 1/105* (2013.01)

(56) References Cited

FOREIGN PATENT DOCUMENTS

| | | |
|---|---|---|
| JP | 2004-185976 | 7/2004 |
| JP | 2006-92832 | 4/2006 |
| JP | 2008-281250 | 11/2008 |
| KR | 0129792 | 8/1998 |
| KR | 10-0826713 | 4/2008 |
| KR | 10-2011-0049269 | 5/2011 |
| KR | 10-2011-0094792 | 8/2011 |
| KR | 10-2014-0098531 | 8/2014 |
| WO | 2012/089506 A1 | 7/2012 |

OTHER PUBLICATIONS

Written Opinion of the International Searching Authority dated Feb. 28, 2017 in corresponding International Patent Application No. PCT/KR2016/014530.

Extended European Search Report dated Nov. 22, 2018 in corresponding European Patent Application No. 16881992.8.

Chinese Office Action dated Jun. 5, 2019 from Chinese Patent Application No. 201680073945.3, 8 pages.

European Office Action dated Aug. 1, 2019 from European Patent Application No. 16881992.8, 4 pages.

* cited by examiner

【Fig. 1】
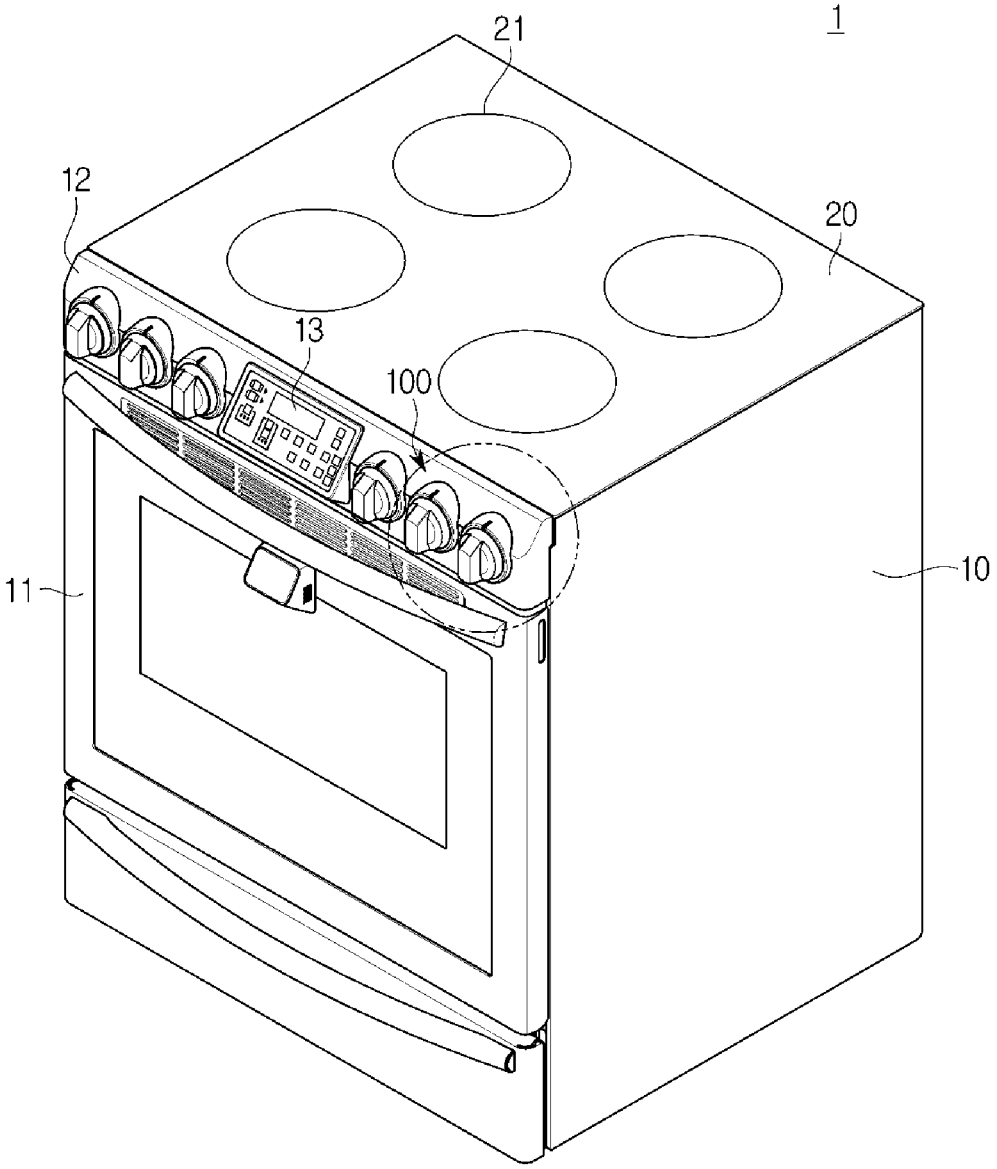

[Fig. 2]
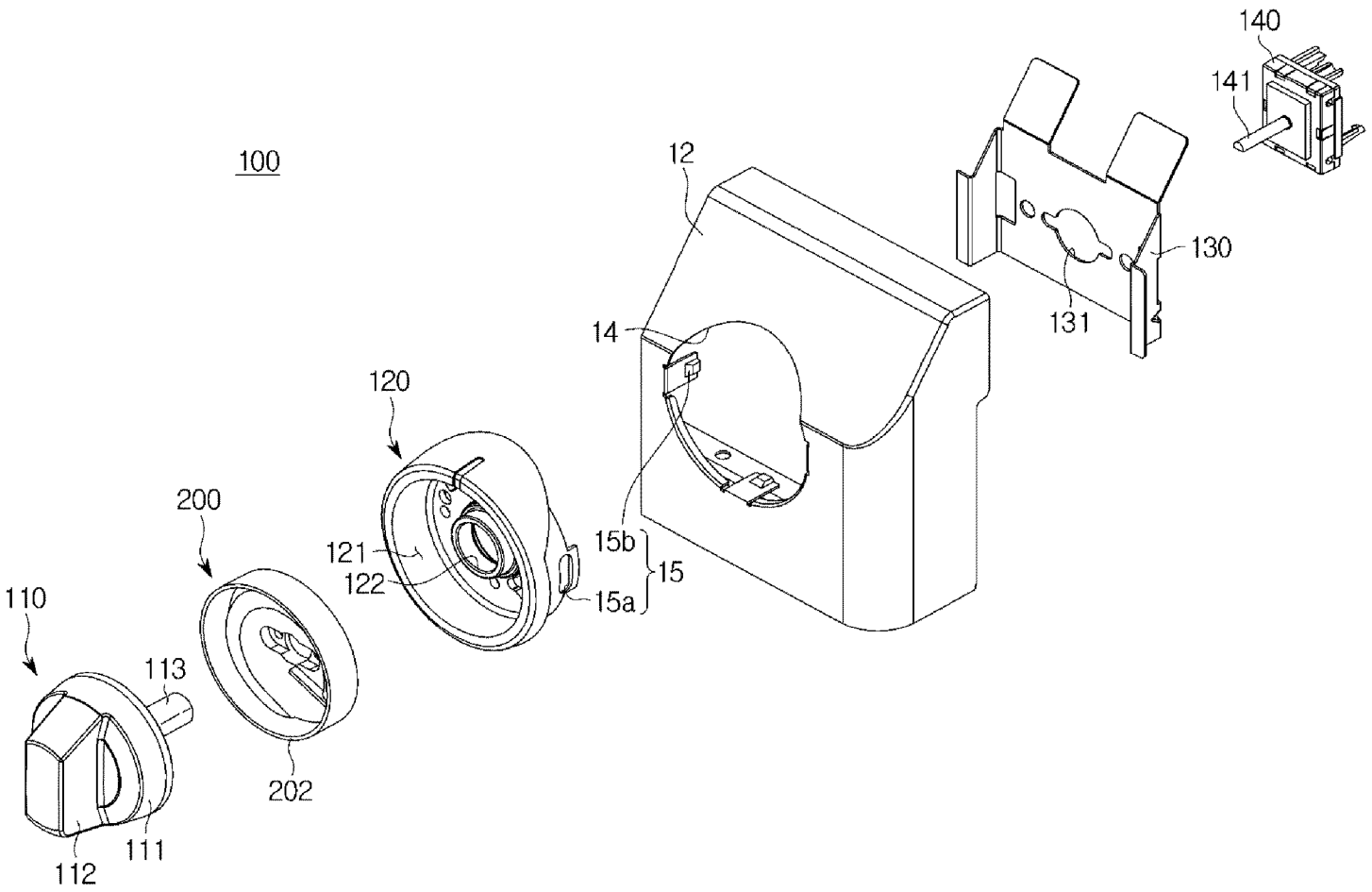

【Fig. 3】
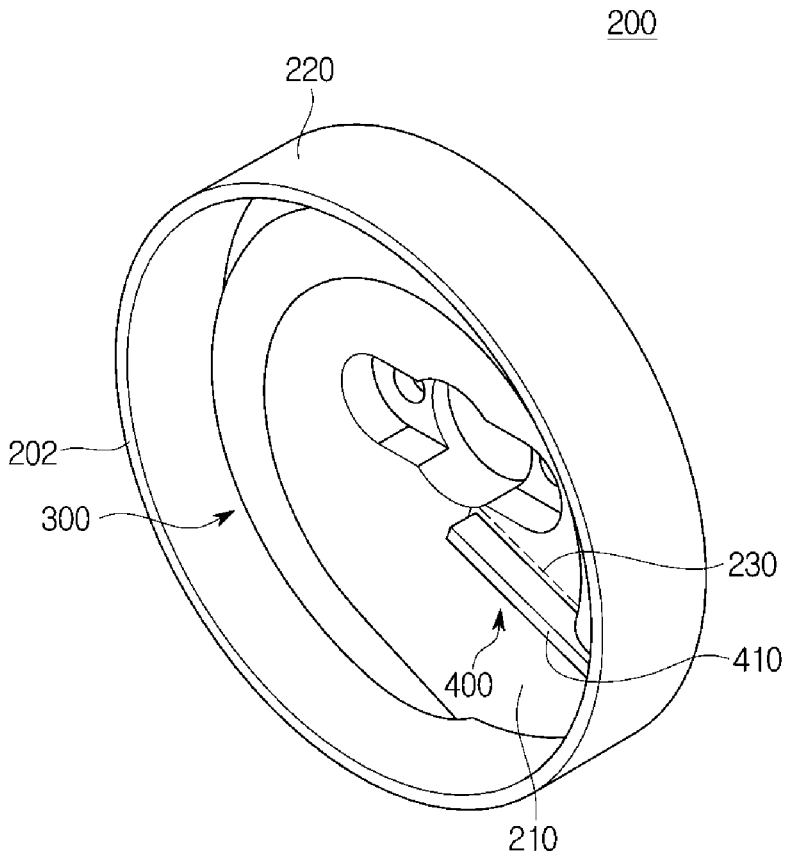

【Fig. 4】
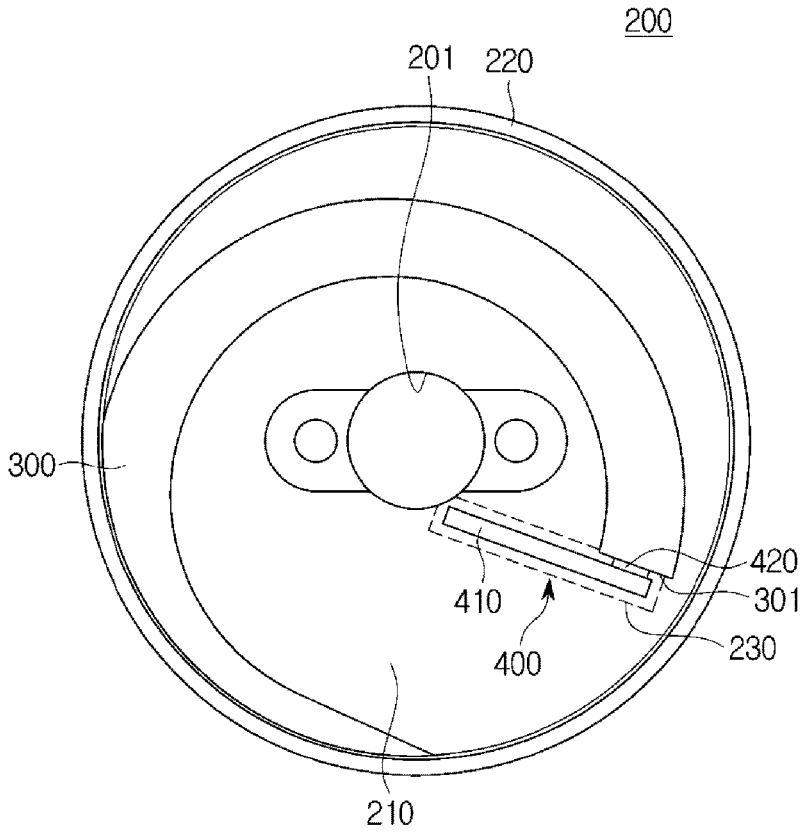

【Fig. 5】
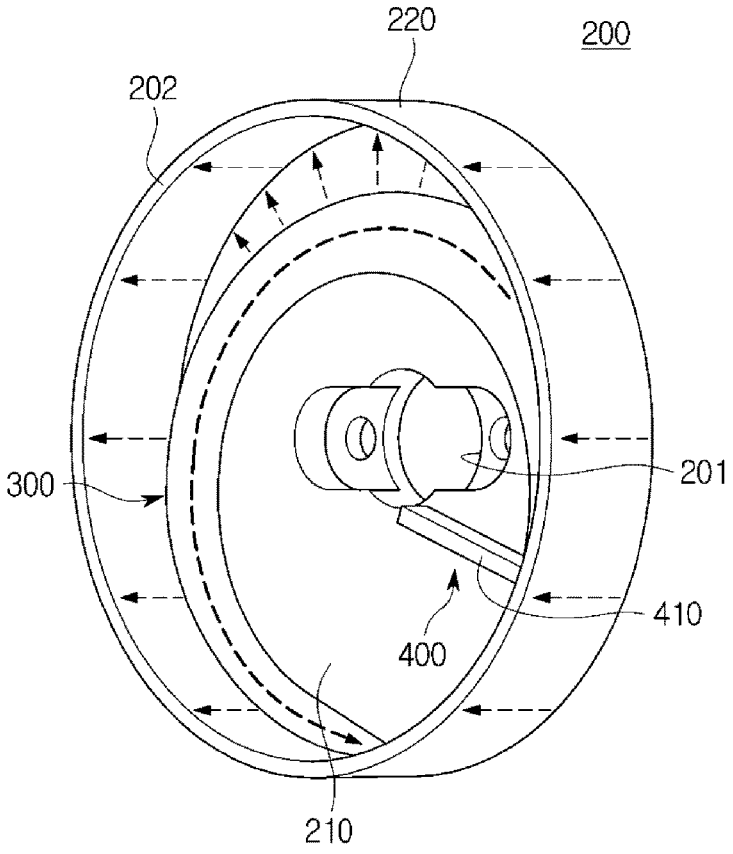

【Fig. 6】
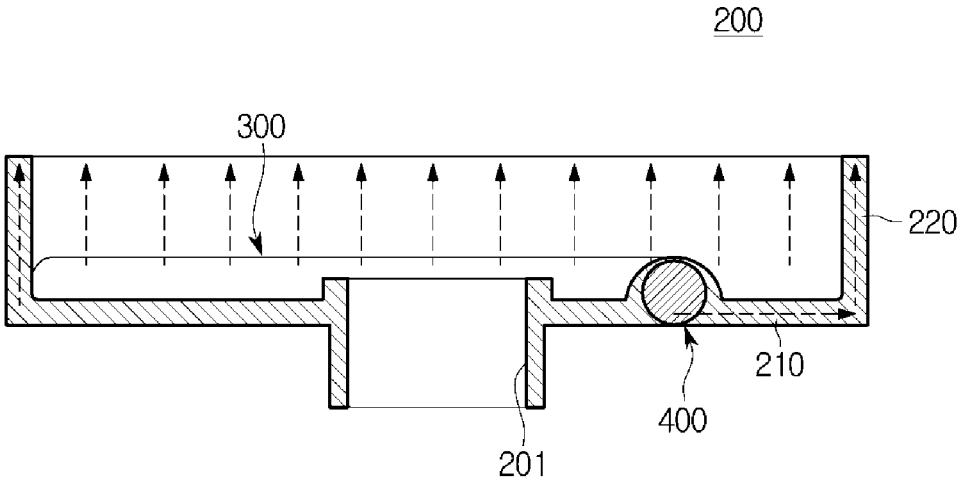

【Fig. 7】
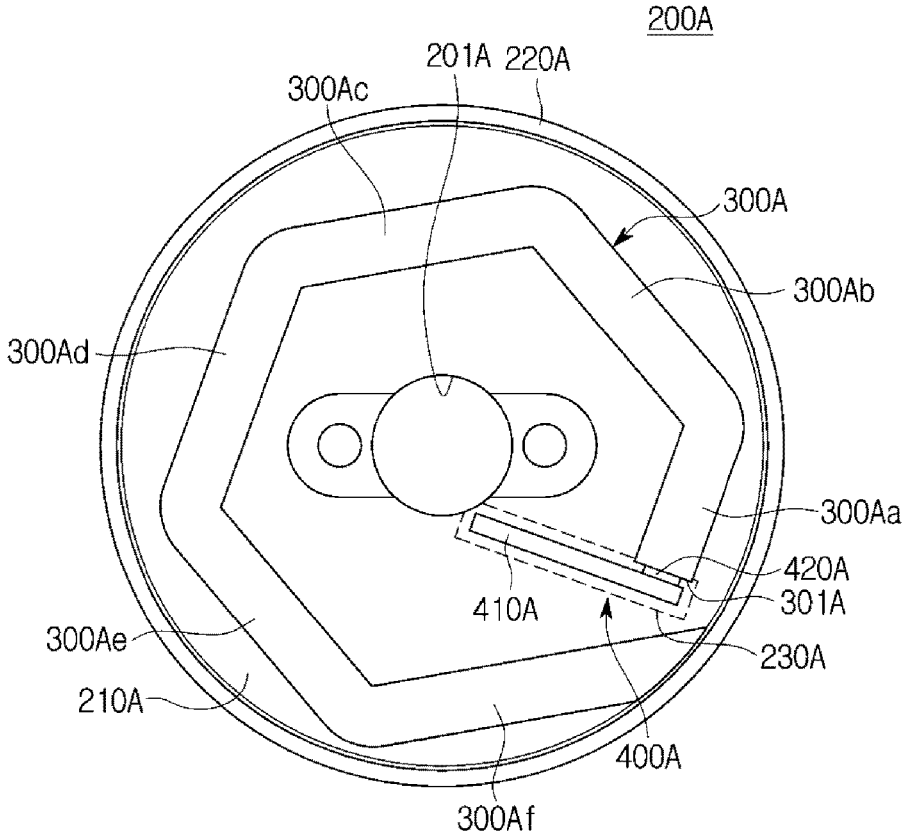

【Fig. 8】
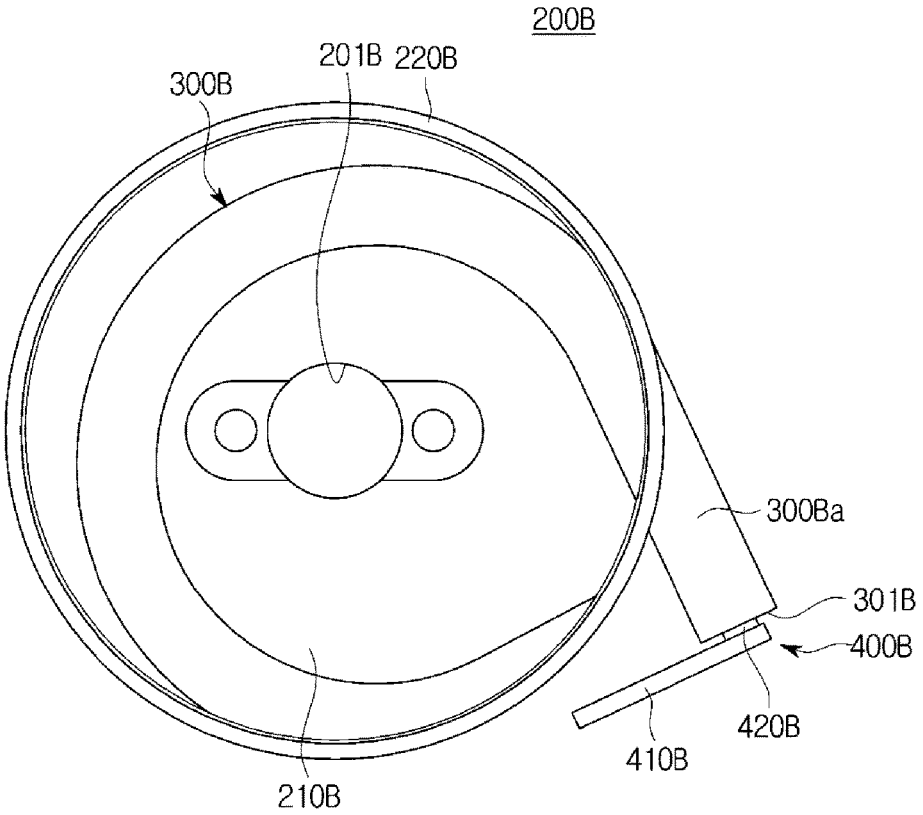

【Fig. 9】
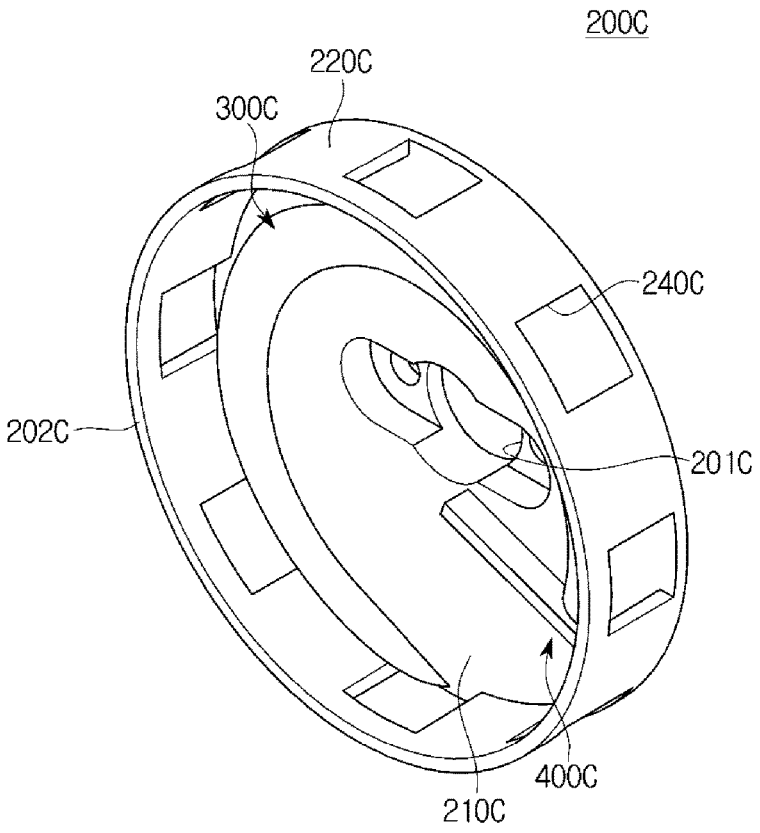

【Fig. 10】
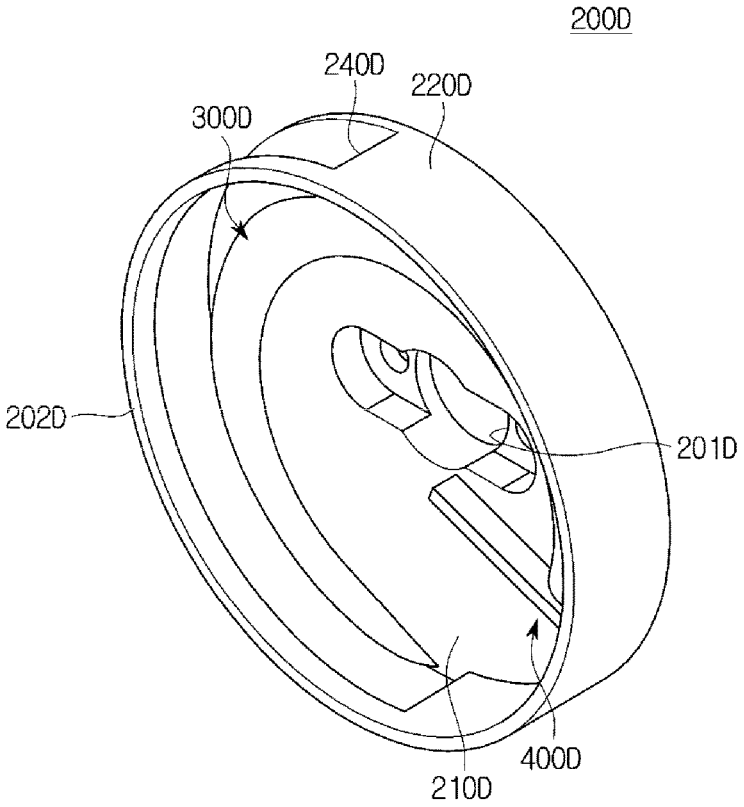

【Fig. 11】
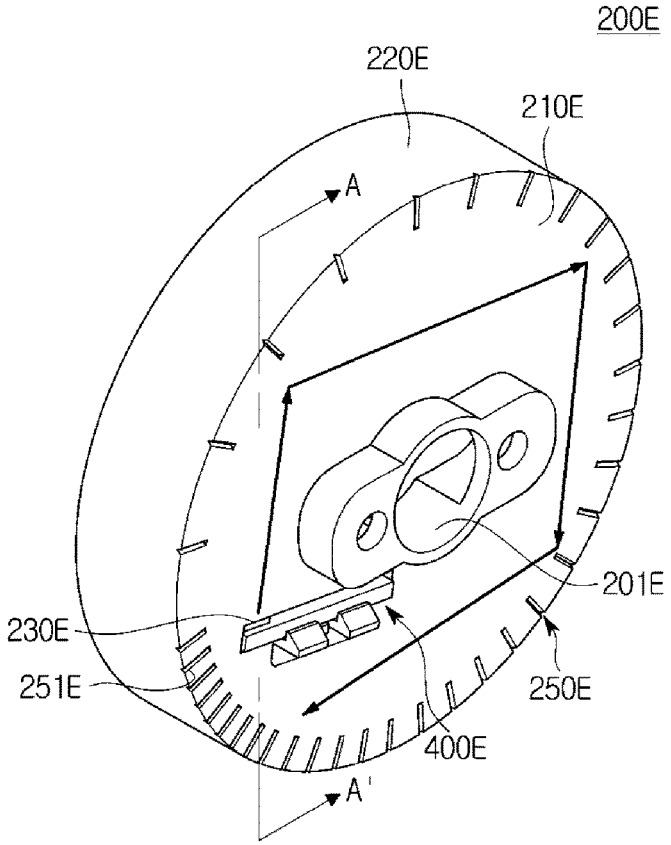

【Fig. 12】
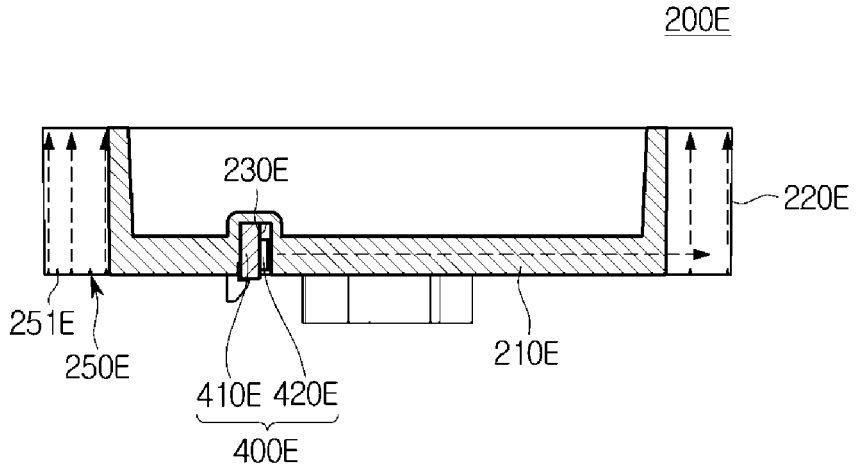

【Fig. 13】
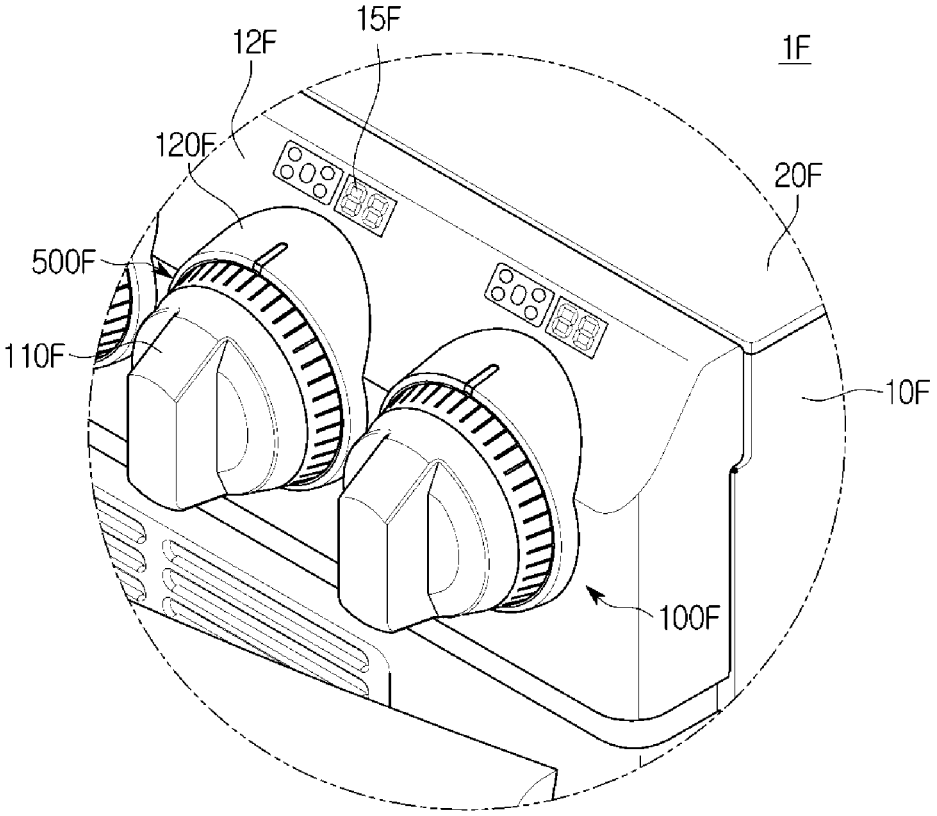

[Fig. 14]
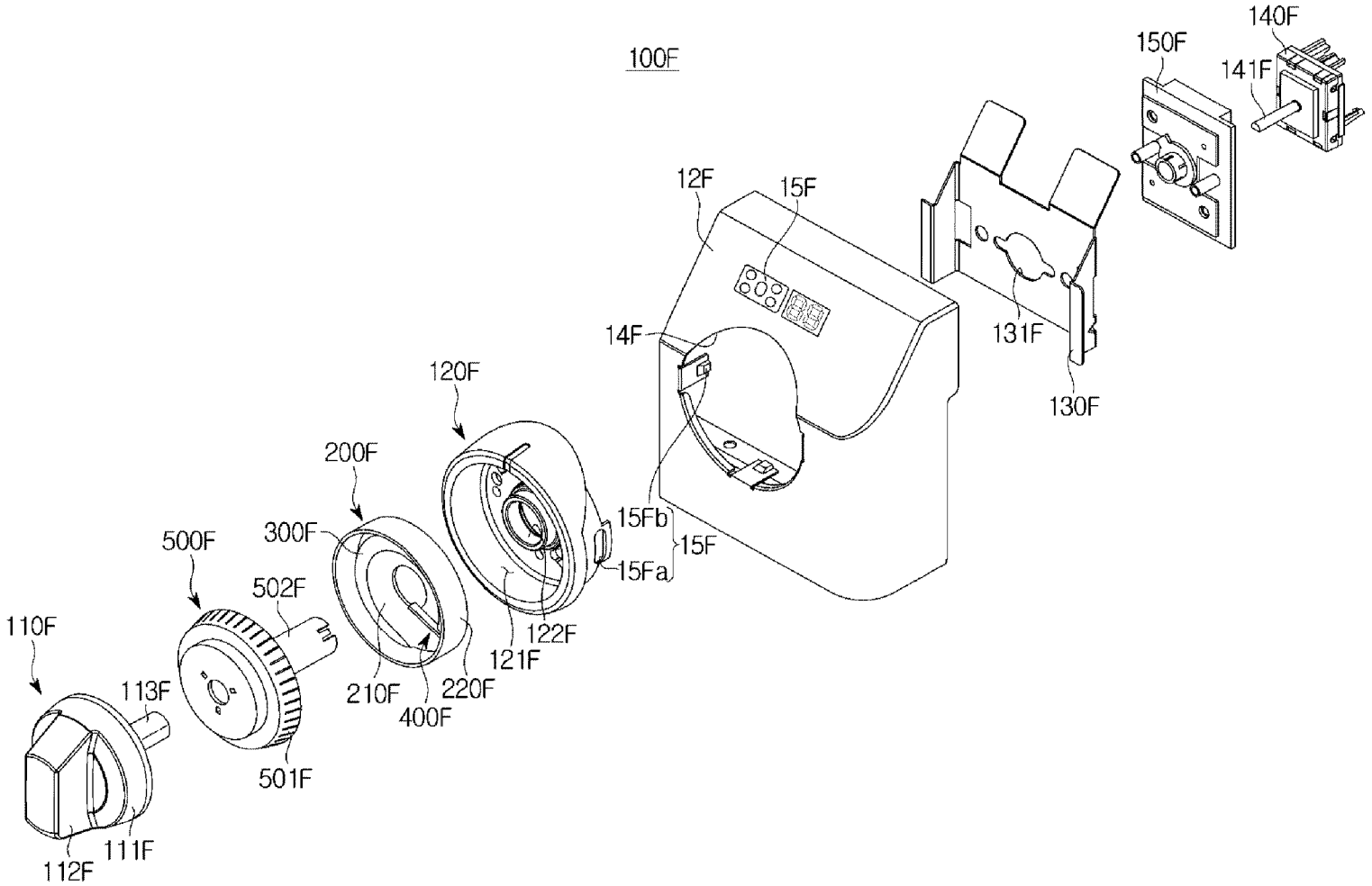

SWITCH ASSEMBLY AND COOKING APPARATUS HAVING THE SAME

CROSS-REFERENCE TO RELATED APPLICATIONS

This application is a National Phase Application under 35 U.S.C. § 371 of PCT International Patent Application No. PCT/KR2016/014530, filed Dec. 12, 2016 which claims the foreign priority benefit under 35 U.S.C. § 119 to Korean Patent Application No. 10-2015-0189227 filed Dec. 30, 2015, the contents of which are incorporated herein by reference.

TECHNICAL FIELD

The present disclosure relates to a switch assembly and a cooking apparatus having the same, and more particularly, to a cooking apparatus having a switch assembly configured to uniformly distribute light emitted around the switch.

BACKGROUND ART

Generally, a cooking apparatus may be provided in various types thereof, and an oven range provided in the form of an oven and a cook top coupled to each other will be used as an example.

The oven range is provided with a main body having the shape of a cabinet, and the oven is provided at the inside of the main body, while the cook top having at least one heating part is provided at an upper portion of the main body. As a source of energy to heat a food substance, electricity or gas may be used.

The main body of the cooking apparatus may be provided with a control panel to operate the cooking apparatus. The control panel may include a plurality of switch assemblies which allow a user to set a desired cooking mode or set various conditions for cooking.

DISCLOSURE

Technical Problem

One aspect of the present disclosure provides a cooking apparatus including a switch assembly configured to uniformly distribute light emitted around the switch.

Another aspect of the present disclosure provides a cooking apparatus including a switch assembly configured to improve visibility by uniformly distributing light through a light guide.

Another aspect of the present disclosure provides a cooking apparatus including a switch assembly configured to allow light to be uniformly distributed to the entire exterior surface of the switch with a minimum number of LEDs to reduce the cost.

Technical Solution

In accordance with an aspect of the present disclosure, there is provided a cooking apparatus comprising: a main body having a cooking chamber; and a switch assembly rotatably mounted on the main body wherein the switch assembly includes: a switch rotatably provided; a switch holder coupled to the switch; and a light guide disposed between the switch and the switch holder to uniformly emit light emitted from a light source.

The light guide may include a first light guide portion provided to disperse the light incident from the light source toward a light emitting surface and a second light guide portion provided to guide the light dispersed by the first light guide portion toward the light emitting surface.

The first light guide portion may be formed in a disk shape and may further comprise a light source mounting portion in which the light source is mounted.

The second light guide portion may include a ring shape extending from an edge of the first light guide portion.

The light guide may further comprise a light guide passage to disperse and totally reflect the light emitted from the light source.

The light source may include an LED and a printed circuit board on which the LED is mounted, and the light source may be configured to be vertically mounted on the light guide.

The light guide passage may be integrally formed with the light guide.

The light guide passage may include at least one of a circle, a hemisphere, a curve, a straight line, and a combination of the curve and the straight line.

The light guide passage may extend outside the second light guide portion and the light source may be arranged outside the light guide and inside the switch holder so as to be in close contact with the light guide passage.

The light guide may include a pattern portion to disperse the light incident from the light source toward the light emitting surface.

The pattern portion may include a plurality of fine patterns formed around the outer periphery of the first light guide portion.

The fine pattern may be formed to have a higher density as the distance from the light source increases.

The second light guide portion may include at least one opening.

In accordance with an aspect of the present disclosure, there is provided a cooking apparatus comprising: a main body; a control panel provided on at least a portion of the main body; and a switch assembly rotatably mounted on the control panel wherein the switch assembly includes: a switch configured to be rotated by a user; a switch holder configured to connect the switch and the control panel; an LED module disposed between the switch and the switch holder; and a light guide provided to uniformly disperse light emitted from the LED module around the switch.

The light guide may include: a first light guide portion provided to disperse the light incident from the LED module toward a light emitting surface and a second light guide portion provided to guide the light dispersed by the first light guide portion toward the light emitting surface.

The first light guide portion may be formed in a disk shape and may include a light source mounting portion in which a light source is mounted.

The second light guide portion may include a ring shape extending from an edge of the first light guide portion.

The light guide may further comprise a light guide passage to disperse and totally reflect the light emitted from the light source.

The LED module may include an LED and a printed circuit board on which the LED is mounted.

The light guide passage may be integrally formed with the light guide.

The light guide passage may include at least one of a circle, a hemisphere, a curve, a straight line, and a combination of the curve and the straight line.

The light guide passage may extend outside the second light guide portion and the light source may be arranged outside the light guide and inside the switch holder so as to be in close contact with the light guide passage.

The light guide may include a pattern portion to disperse the light incident from the LED.

The pattern portion may include a plurality of fine patterns formed around the outer periphery of the first light guide portion.

The fine pattern may be formed to have a higher density as the distance from the light source increases.

The second light guide portion may include at least one opening spaced apart from each other in the circumferential direction.

In accordance with an aspect of the present disclosure, there is provided a switch assembly comprising: a switch rotatably provided; a switch holder to rotatably support the switch; an LED module provided between the switch and the switch holder; and a circular light guide arranged to uniformly distribute light incident from the LED module around the switch.

The light guide may include: a first light guide portion having a disc shape and provided to disperse the light incident from the LED module toward a light emitting surface and a second light guide portion having a ring shape and provided to guide the light dispersed by the first light guide portion toward the light emitting surface.

The light guide may further comprise a light guide passage to disperse and totally reflect the light emitted from a light source.

The light guide passage may be provided inside the second light guide portion so that the LED is in close contact with the light guide passage.

The light guide passage may include at least one of a circle, a hemisphere, a curve, a straight line, and a combination of the curve and the straight line.

The light guide passage may extend outside the second light guide portion and the light source may be arranged outside the light guide and inside the switch holder so as to be in close contact with the light guide passage.

The light guide may include a pattern portion to disperse the light incident from the LED.

The pattern portion may include a plurality of fine patterns formed around the outer periphery of the first light guide portion.

The fine pattern may be formed to have a higher density as the distance from the light source increases.

Advantageous Effects

According to the embodiments of the present disclosure, the light emitted around the switch can be uniformly distributed through the light guide, so that the visibility can be improved.

In addition, since light can be uniformly diffused over the entire light emitting surface with one light emitting diode (LED), the cost can be reduced.

DESCRIPTION OF DRAWINGS

FIG. 1 is a perspective view illustrating an appearance of a cooking apparatus according to one embodiment of the present disclosure.

FIG. 2 is an exploded perspective view illustrating a switch assembly of the cooking apparatus according to one embodiment of the present disclosure.

FIG. 3 is a perspective view illustrating a light guide of the switch assembly according to one embodiment of the present disclosure.

FIG. 4 is a front view of the light guide according to one embodiment of the present disclosure.

FIG. 5 and FIG. 6 are views illustrating a light path by the light guide according to one embodiment of the present disclosure.

FIG. 7 is a view illustrating a light guide passage of a light guide according to a second embodiment of the present disclosure.

FIG. 8 is a view illustrating a light guide according to a third embodiment of the present disclosure.

FIG. 9 is a view illustrating a light guide according to a fourth embodiment of the present disclosure.

FIG. 10 is a view illustrating a light guide according to a fifth embodiment of the present disclosure.

FIG. 11 is a view illustrating a light guide according to a sixth embodiment of the present disclosure.

FIG. 12 is a sectional view taken along line A-A' in FIG. 11, illustrating a light path by the light guide according to the sixth embodiment of the present disclosure.

FIG. 13 is a view illustrating an appearance of a cooking apparatus in which a switch assembly according to a seventh embodiment of the present disclosure is installed.

FIG. 14 is an exploded perspective view illustrating the switch assembly according to the seventh embodiment of the present disclosure.

MODES

Hereinafter, embodiments according to the present disclosure will be described in detail with reference to the accompanying drawings.

FIG. 1 and FIG. 2 are views illustrating a cooking apparatus equipped with a switch assembly according to one embodiment of the present disclosure.

As shown in FIG. 1 and FIG. 2, a cooking apparatus 1 includes a main body 10 forming an outer appearance thereof and a cooking chamber (not shown) in which a space for cooking food is formed in the main body 10. A cooktop 20 having at least one heating part 21 may be provided on an upper side of the main body 10. Electricity or gas may be used as an energy source for heating the food.

The main body 10 may be provided with a control panel 12 to operate the cooking apparatus 1.

The control panel 12 includes a switch assembly 100 provided for a user to operate the cooking apparatus 1 directly and a display unit 13 for displaying the operating state of the cooking apparatus 1. Although the control panel 12 is disposed on an upper side of a front surface of the main body 10 in the present embodiment, the present embodiment is not limited thereto.

A door 11 may be provided under the control panel 12 of the main body 10 to selectively open and close the cooking chamber.

In the embodiment of the present disclosure, the cooking apparatus 1 includes an integrated oven in which the cooking chamber and the cooktop 20 are provided. However, the cooking apparatus is not limited thereto, and may include all the products to which the control panel 12 and the switch assembly 100 are mounted.

In addition, although the control panel 12 is illustrated as being detachably mountable to the main body 10, the spirit of the present disclosure is not limited thereto. For example, the control panel 12 may be integrally formed with the main body 10.

On the other hand, at least a portion of the control panel 12 may be provided with the display unit 13 for displaying a cooking time, a cooking type, or a cooking process in order to provide operating state information of the cooking apparatus 1 to a user. A circuit board (not shown) connected to the display unit 13 may be provided in the internal space of the control panel 12.

The switch assembly 100 to operate the cooking apparatus 1 may be installed at another portion of the control panel 12.

The switch assembly 100 may include a switch 110 which is rotatably provided. The switch 110 may be rotatably mounted on the control panel 12 by a switch holder 120. The switch assembly 100 may further include a light guide 200 disposed between the switch 110 and the switch holder 120. The light guide 200 is disposed between the switch 110 and the switch holder 120 so that the light emitted from an LED module 400 is uniformly emitted to a periphery of the switch 110.

The switch 110 may be rotatably installed with respect to the main body 10 and the control panel 12 to control the heating power of the heating unit 21 of the cooktop 20 of the cooking apparatus 1.

The switch 110 includes a circular switch body 111, a handle 112 protruding from a front surface of the switch body 111 and a switch connecting portion 113 protruding rearward from the inner center of the switch body 111.

The handle 112 of the switch 110 may be formed in a straight line so as to cross a center of the switch 110 so that a user can easily rotate the switch.

The control panel 12 may include an installation hole 14 to install the switch assembly 100. The installation hole 14 is formed through at least a portion of the control panel 12. At least one or more installation holes 14 may be formed corresponding to the number of switch assemblies 100. The installation hole 14 may be formed in a size and shape corresponding to the switch 110. The installation hole 14 may be formed in a circular shape.

The switch holder 120 may be coupled to the installation hole 14 of the control panel 12. The switch holder 120 may have a switch accommodating portion 121 formed therein. The switch accommodating portion 121 may be formed in a shape corresponding to the switch body 111 so that the switch 110 is rotatably coupled. A switch holder hole 122 through which the switch connecting portion 113 of the switch 110 passes may be formed at the center of the switch holder 120. The switch holder 120 may be coupled to the installation hole 14 of the control panel 12 by a coupling unit 15. A first coupling unit 15*a* to be coupled with the installation hole 14 of the control panel 12 is provided at the rear of the outer circumferential surface of the switch holder 120. The installation hole 14 of the control panel 12 may be provided with a second coupling unit 15*b* corresponding to the first coupling unit 15*a* of the switch holder 120.

The switch assembly 100 may further include a support bracket 130 provided at the rear of the control panel 12. The support bracket 130 may be disposed at the rear of the installation hole 14 of the control panel 12 so as to support and fix the switch holder 120 and the switch 110 to the control panel 12. The support bracket 130 has a through hole 131 at the center thereof and is provided to connect the switch 110 and a regulator 140 provided at the rear of the support bracket 130. The regulator 140 includes a regulator connecting portion 141. The regulator connecting portion 141 passes through the through hole 131 of the support bracket 130, the installation hole 14 of the control panel 12, the switch holder hole 122 of the switch holder 120, and the light guide 200 and may be connected to the switch connecting portion 113 of the switch 110.

The light guide 200 may be provided between the switch 110 and the switch holder 120 of the switch assembly 100.

FIG. 3 is a perspective view illustrating a light guide of the switch assembly according to one embodiment of the present disclosure and FIG. 4 is a front view of the light guide according to one embodiment of the present disclosure and FIG. 5 and FIG. 6 are views illustrating a light path by the light guide according to one embodiment of the present disclosure.

As shown in FIG. 3 to FIG. 6, the light guide 200 of the switch assembly 100 is provided to uniformly emit the light incident from the light source 400 (hereinafter, LED module 400) to a light emitting surface 202. The light emitting surface 202 may be formed in a ring shape around the switch 110.

The light guide 200 includes a first light guide portion 210 configured to disperse the light incident from the LED module 400 toward the light emitting surface 202, and a second light guide portion 220 configured to guide the light dispersed by the first light guide portion 210 toward the light emitting surface 202.

The light guide 200 may include an injection mold to allow light incident from the LED module 400 to be emitted.

The LED module 400 may include an LED 420 and a printed circuit board 410 on which the LED 420 is mounted.

The first light guide portion 210 may be formed in a disc shape. The first light guide portion 210 may be formed to have a size corresponding to the switch accommodating portion 121 so as to be accommodated in the switch accommodating portion 121 of the switch holder 120.

The first light guide portion 210 may include a light source mounting portion 230 for mounting the LED module 400. The light source mounting portion 230 is formed as a space for mounting the LED module 400. The printed circuit board 410 and the LED 420 mounted on the printed circuit board 410 may be mounted on the light source mounting portion 230.

The second light guide portion 220 may extend from the edge of the first light guide portion 210. The second light guide portion 220 may be bent forward from the first light guide portion 210. The second light guide portion 220 may be formed in a ring shape. The second light guide portion 220 may include a ring shape extending forward from the edge of the first light guide portion 210.

The light guide 200 may further include a light guide passage 300 for dispersing and totally reflecting light emitted from the LED module 400. The light guide passage 300 prevents the light emitted from the LED 420 from being stronger only in the vicinity of the LED 420. The light guide passage 300 is provided so that light emitted from the LED 420 is uniformly emitted from the light emitting surface 202.

The light guide passage 300 may be formed in the first light guide portion 210. The light guide passage 300 may protrude from the front surface of the first light guide portion 210 and may be integrally formed with the first light guide portion 210. The light guide passage 300 may be formed to be smaller than the second light guide portion 220 so as to be disposed inside the second light guide portion 220. The light guide passage 300 may include a circle eccentrically disposed from the center of the first light guide portion 210. The light guide passage 300 may be formed to include a curved shape. The light guide passage 300 may be formed to include a semicircular shape. The cross section of the light guide path 300 may include a circle. The light guide passage 300 may include an LED contacting portion 301 so that the LED 420 is in close contact with one end portion thereof. The LED contacting portion 301 may be disposed at one end of the light guide passage 300.

The light emitted from the LED 420 is emitted along the first light guide portion 210 and follows the curved shape along the light guide passage 300. The light which does not satisfy the total reflection angle is dispersed out of the curved shape. The light dispersed out of the curved shape is guided to the light emitting surface 202 along the second light guide portion 220 and is uniformly emitted to the light emitting surface 202.

In this case, total reflection means that when light travels from a high-refractive-index object to a low-refractive object, the light is reflected according to an incidence angle of the light on the interface. Although not shown in the center of the light guide 200, an installation hole 201 may be formed in the light guide 200.

A wire connected to the printed circuit board 410 of the LED module 400 to apply external power may be coupled to the light guide 200 through the installation hole 201.

In addition, in the embodiment of the present disclosure, the light source mounting portion 230 is provided at a predetermined position on the front surface of the first light guide portion 210, and the printed circuit board 410 is mounted on the light source mounting portion 230. Although the LED 420 is vertically arranged at one end of the printed circuit board 410 so as to be in contact with the light guide passage 300, the present embodiment is not limited thereto. For example, the light source mounting portion 230 may be recessed inward from the front surface of the first light guide portion 210.

FIG. 7 is a view illustrating a light guide passage of a light guide according to a second embodiment of the present disclosure. Reference numerals not shown refer to FIGS. 1 to 6.

As shown in FIG. 7, a light guide 200A may further include a light guide passage 300A for dispersing and totally reflecting light emitted from an LED module 400A.

The light guide passage 300A may protrude from a first light guide portion 210A. The light guide passage 300A may be integrally formed with the first light guide portion 210A by injection molding. The light guide passage 300A may include a curved or straight line.

The light guide passage 300A may be formed by a combination of at least one curved or straight line.

The light guide passage 300A may include at least one of circular, hemispherical, or hexagonal shapes arranged eccentrically from the center of the first light guide portion 210A. The light guide passage 300A may include at least one of a hemispherical shape, a circular shape, or a hexagonal shape. The light guide passage 300A may include an LED contacting portion 301A formed to be flat so that an LED 420A tightly contacts one end of the light guide passage 300A. The LED contacting portion 301A may be formed at one end of the light guide passage 300A.

As shown in FIG. 7, the light guide passage 300A including the straight line includes a first light guide passage 300Aa having the LED contacting portion 301A formed at one end thereof, a second light guide passage 300Ab having a straight line shape and extending from the first light guide passage 300Aa at a predetermined angle, a third light guide passage 300Ac having a straight line shape and extending from the second light guide passage 300Ab at a predetermined angle, a fourth light guide passage 300Ad having a straight line shape and extending from the third light guide passage 300Ac at a predetermined angle, a fifth light guide passage 300Ae having a straight line shape and extending from the fourth light guide passage 300Ad at a predetermined angle and a sixth light guide passage 300Af having a straight line shape and extending from the fifth light guide passage 300Ae at a predetermined angle. The light guide passage 300A formed through the first to sixth light guide passages 300Aa, 300Ab, 300Ac, 300Ad, 300Ae and 300Af may include a hexagonal shape.

The light emitted from the LED 420A of the LED module 400A is incident through the LED contacting portion 301A of the first light guide passage 300Aa and is reflected along the hexagonal light guide passage 300A. Light which does not satisfy the total reflection angle is dispersed out of the curved shape. The light dispersed out of the curved shape is guided to a light emitting surface 202A along a ring-shaped second light guide portion 220A and is uniformly emitted to the light emitting surface 202A.

In this case, total reflection means that when light travels from a high-refractive-index object to a low-refractive object, the light is reflected according to an incidence angle of the light on the interface.

Since the uniform light emission operation of the light guide 200A according to the above-described configuration may be predicted from the above description, a duplicate description will be omitted.

FIG. 8 is a view illustrating a light guide according to a third embodiment of the present disclosure. Reference numerals not shown refer to FIGS. 1 to 6.

As shown in FIG. 8, a light guide 200B may further include a light guide passage 300B for dispersing and totally reflecting light emitted from an LED module 400B.

The LED module 400B may be disposed outside the light guide 300B. The LED module 400B may include an LED 420B and a printed circuit board 410B on which the LED 420B is mounted.

The LED module 400B may be disposed outside a second light guide portion 220B of the light guide 200B. The LED module 400B may be provided in the switch holder 120.

The LED module 400B may be disposed in the switch accommodating portion 121 of the switch holder 120.

The light guide passage 300B may extend outside the second light guide portion 220B of the light guide 200B. The light guide passage 300B may include an extended light guide passage 300Ba provided with an LED contacting portion 301B formed to tightly contact the LED 420B of the LED module 400B. The extended light guide passage 300Ba may extend from the light guide passage 300B formed in the first light guide portion 210B and protrude to the outside of the light guide 200B.

The light emitted from the LED 420B in close contact with the LED contacting portion 301B of the extended light guide passage 300Ba disposed outside the light guide 200B is incident through the LED contacting portion 301B and is reflected along the light guide passage 300B. Light which does not satisfy the total reflection angle is dispersed out of the curved shape. The light dispersed out of the curved shape is guided to a light emitting surface 202B along the ring-shaped second light guide portion 220B and is uniformly emitted to the light emitting surface 202B.

Since the uniform light emission operation of the light guide 200B according to the above-described configuration may be predicted from the above description, a duplicate description will be omitted.

FIG. 9 is a view illustrating a light guide according to a fourth embodiment of the present disclosure and FIG. 10 is a view illustrating a light guide according to a fifth embodiment of the present disclosure. Reference numerals not shown refer to FIGS. 1 to 6.

As shown in FIG. 9, a light guide 200C may include a first light guide portion 210C and a second light guide portion 220C.

The light guide 200C includes the first light guide portion 210C provided to disperse the light incident from an LED module 400C toward a light emitting surface 202C and the second light guide portion 220C provided to guide the light dispersed by the first light guide portion 210C toward the light emitting surface 202C.

The first light guide portion 210C may be formed in a disc shape. The second light guide portion 220C may extend from an edge of the first light guide portion 210C. The second light guide portion 220C may include a ring shape extending forward from the edge of the first light guide portion 210C.

The light guide 200C may further include a light guide passage 300C for dispersing and totally reflecting light emitted from the LED module 400C. The light guide passage 300C is provided so as to emit light uniformly on the light emitting surface 202C.

The light guide passage 300C may be integrally formed with the first light guide portion 210C by injection molding.

The second light guide portion 220C of the light guide 200C may include at least one opening 240C. The plurality of openings 240C may be spaced apart from each other at intervals in the circumferential direction of the second light guide portion 220C. The plurality of openings 240C are configured to block light emitted from the LED 420A of the LED module 400A.

Accordingly, the light incident on the light guide passage 300C through the LED module 400C is transmitted and dispersed along the first light guide portion 210C and the light guide passage 300C, and is guided through the second light guide portion 220C. At this time, the light uniformly emitted through the second light guide portion 220C is blocked by the openings 240C, so that the light is uniformly emitted.

As shown in FIG. 10, an opening 240D of a light guide body 200D may be formed in a semicircular shape on the upper side of a second light guide portion 220D.

The light is blocked by the upper opening of the second light guide portion 220D and uniformly guided by the lower side of the second light guide portion 220D so as to be uniformly emitted to the lower semicircular portion of the switch 110.

In the embodiment of the present disclosure, a semicircular opening 220D is formed on the upper portion of the second light guide portion 220D so that light is uniformly emitted to the lower portion of the light emitting surface formed in the ring shape around the switch 110. However, the embodiment of the present disclosure is not limited thereto. For example, the openings 240D may be formed on the lower semicircular portion of the second light guide portion 220D so that light is uniformly emitted to the upper portion of the ring shape around the switch 110.

Since the uniform light emission operation of the light guides 200C, 200D according to the above-described configuration may be predicted from the above description, a duplicate description will be omitted.

FIG. 11 is a view illustrating a light guide according to a sixth embodiment of the present disclosure and FIG. 12 is a sectional view taken along line A-A' in FIG. 11, illustrating a light path by the light guide according to the sixth embodiment of the present disclosure. Reference numerals not shown refer to FIGS. 1 to 6.

As shown in FIG. 11 and FIG. 12, a light guide 200E may further include a pattern portion 250E for dispersing light emitted from an LED module 400E.

The light guide 200E may include a first light guide portion 210E and a second light guide portion 220E.

The first light guide portion 210E may be formed in a disc shape. The second light guide portion 220E may extend from an edge of the first light guide portion 210E. The second light guide portion 220E may include a ring shape extending forward from the edge of the first light guide portion 210E.

The light guide 200E may further include a light source installation portion 230E. The light source installation portion 230E may be formed by being recessed at one side of the bottom surface of the first light guide portion 210E. The LED module 400E is inserted into the light source installation portion 230E. The LED module 400E may be inserted into the light guide 200E by the light source installation portion 230E. The LED module 400E may be disposed inside the light guide 200E.

The LED module 400E may include an LED 420E and a printed circuit board 410E for mounting the LED 420E.

The LED 420E may be inserted into the light guide 200E by the light source installation portion 230E and arranged vertically.

The pattern portion 250E of the light guide 200E may be formed around the bottom surface of the first light guide portion 210E. The pattern portion 250E may include a plurality of fine patterns 251E.

The plurality of fine patterns 251E may be arranged to be spaced apart from each other by a predetermined distance. The plurality of fine patterns 251E may be arranged in a circle around the outer periphery of the first light guide portion 210E.

The light guide 200E in which the pattern portion 250E is formed is configured such that light emitted from the LED module 400E inserted into the light source installation unit 230E of the first light guide portion 210E is totally reflected at the fine patterns 251E of the light guide 200E and rotates 360 degrees. (See arrows in FIG. 11)

At this time, a portion of the light is totally reflected on the fine pattern 251E on the rear surface of the light guide 200E and emitted vertically.

The plurality of fine patterns 251E are formed so as to have a higher density as the distance from the LED module 400E increases, so that light is uniformly emitted from the LED module 400E.

Since the uniform light emission operation of the light guide 200E according to the above-described configuration may be predicted from the above description, a duplicate description will be omitted.

FIG. 13 is a view illustrating an appearance of a cooking apparatus in which a switch assembly according to a seventh embodiment of the present disclosure is installed and FIG. 14 is an exploded perspective view illustrating the switch assembly according to the seventh embodiment of the present disclosure.

As shown in FIG. 13 and FIG. 14, a cooking apparatus 1F may include a cooktop 20F provided on the upper portion of a main body 10F and a control panel 12F provided to control the operation of the cooking apparatus 1F.

The control panel 12F may be provided with a switch assembly 100F for operating the cooking apparatus 1F.

The switch assembly 100F may include a switch 110F which is rotatably provided by a user. The switch 110F may be rotatably mounted on the control panel 12F by a switch holder 120F. A timer 500F may be provided between the switch 110F and the switch holder 120F.

The timer 500F may be provided for a user to adjust the cooking time of the cooktop 20F. The timer 500F may include a rotatable timer handle 501F and an encoder connecting part 502F which rotatably connects the timer handle 501F to an encoder 150F.

The timer 500F is rotatably installed between the switch 110F and the switch holder 120F and may be connected to the encoder 150F and a regulator 140F provided at the rear of the control panel 12F.

The encoder 150F converts the rotation of the timer 500F into an electrical signal to be displayed on the timer display 15F provided on the control panel 12F.

The switch assembly 100F may further include a light guide 200F disposed between the timer 500F and the switch holder 120F. The light guide 200F is disposed between the timer 500F and the switch holder 120F so that the light emitted from an LED module 400F is uniformly emitted around the switch 110F and the timer 500F.

The switch 110F and the timer 500F may be rotatably installed with respect to the main body 10F and the control panel 12F for adjusting the heating power of the heating unit 21 of the cooktop 20F.

The switch 110F includes a circular switch body 111F, a handle 112F protruding from the front surface of the switch body 111F and a switch connecting portion 113F protruding rearward from an inner center of the switch body 111F.

The handle 112F of the switch 110F may be formed in a straight line which crosses the center of the switch 110F so that the user can easily rotate the switch.

The control panel 12F may include an installation hole 14F to install the switch assembly 100F. The installation hole 14F is formed through at least a portion of the control panel 12F. At least one or more installation holes 14F may be formed corresponding to the switch 110F of switch assembly 100F. The switch holder 120F may be coupled to the installation hole 14F of the control panel 12F. The switch holder 120F may have a switch accommodating portion 121F formed therein. The switch accommodating portion 121F may be formed in a shape corresponding to the switch body 111F so that the switch 110F is rotatably coupled. A switch holder hole 122F through which the switch connecting portion 113F of the switch 110F passes may be formed at the center of the switch holder 120F. The switch holder 120F may be coupled to the installation hole 14F of the control panel 12F by a coupling unit 15F. A first coupling unit 15Fa to be coupled with the installation hole 14F of the control panel 12F is provided at the rear of the outer circumferential surface of the switch holder 120F. The installation hole 14F of the control panel 12F may be provided with a second coupling unit 15Fb corresponding to the first coupling unit 15Fa of the switch holder 120F. The encoder connecting part 502F of the timer 500F may pass through the switch holder hole 122F.

The switch assembly 100F may further include a support bracket 130F provided at the rear of the control panel 12F. The support bracket 130F may be disposed at the rear of the installation hole 14F of the control panel 12F so as to support and fix the switch holder 120F and the switch 110F to the control panel 12F. The support bracket 130F has a through hole 131F at the center thereof and is provided to connect the switch 110F and the regulator 140F provided at the rear of the support bracket 130 and connect the timer 500F and the encoder 150F.

The light guide 200F is disposed between the timer 500F and the switch holder 120F so that the light emitted from the LED module 400F is uniformly emitted around the switch 110F and the timer 500F.

Since the uniform light emission operation of the light guide 200F according to the above-described configuration may be predicted from the above description, a duplicate description will be omitted.

In addition, a structure for uniformly emitting light including the switch assembly to which the light guide is applied may be used in various fields such as in the field of home appliances that include drum washing machines and microwave ovens as well as cooking appliances.

Although a few embodiments of the present invention have been shown and described above, the invention is not limited to the aforementioned specific exemplary embodiments. Those skilled in the art may variously modify the invention without departing from the gist of the invention claimed by the appended claims.

The invention claimed is:

1. A cooking apparatus comprising:

a main body having a cooking chamber; and a switch assembly mounted on the main body, wherein the switch assembly includes:

a switch rotatably provided;

a switch holder coupled to the switch; and a light guide disposed between the switch and the switch holder and having a light emitting surface to uniformly emit light from a light source to a periphery of the switch, the light source being arranged between the switch and the light guide.

2. The cooking apparatus of claim 1, wherein the light guide includes a first light guide portion provided to disperse the light incident from the light source toward the light emitting surface, and a second light guide portion provided to guide the light dispersed by the first light guide portion toward the light emitting surface.

3. The cooking apparatus of claim 2, wherein the first light guide portion is formed in a disk shape and further comprises a light source mounting portion in which the light source is mounted.

4. The cooking apparatus of claim 2, wherein the second light guide portion includes a ring shape extending from an edge of the first light guide portion.

5. The cooking apparatus of claim 1, wherein the light guide further comprises a light guide passage to disperse and totally reflect the light emitted from the light source.

6. The cooking apparatus of claim 5, wherein the light source includes an LED and a printed circuit board on which the LED is mounted, and the light source is configured to be vertically mounted on the light guide.

7. The cooking apparatus of claim 6, wherein the light guide passage is integrally formed with the light guide.

8. The cooking apparatus of claim 5, wherein the light guide passage includes at least one of a circle, a hemisphere, a curve, a straight line, and a combination of the curve and the straight line.

9. The cooking apparatus of claim 7, wherein the light guide passage extends outside the second light guide portion, and the light source is arranged outside the light guide and inside the switch holder so as to be in close contact with the light guide passage.

10. The cooking apparatus of claim 2, wherein the light guide includes a pattern portion to disperse the light incident from the light source toward the light emitting surface.

11. The cooking apparatus of claim 10, wherein the pattern portion includes a plurality of fine patterns formed around the outer periphery of the first light guide portion.

12. The cooking apparatus of claim 11, wherein the fine pattern is formed to have a higher density as the distance from the light source increases.

13. The cooking apparatus of claim 2, wherein the second light guide portion includes at least one opening.

* * * * *